US005653415A

United States Patent [19]

Schwörer

[11] Patent Number: 5,653,415

[45] Date of Patent: Aug. 5, 1997

[54] ADJUSTABLE-HEIGHT SUPPORT FOR SHUTTERING IN THE BUILDING TRADE

[75] Inventor: Artur Schwörer, Senden, Germany

[73] Assignee: PERI GmbH, Weissenhorn, Germany

[21] Appl. No.: 313,125

[22] PCT Filed: Apr. 1, 1993

[86] PCT No.: PCT/DE93/00319

§ 371 Date: Sep. 30, 1994

§ 102(e) Date: Sep. 30, 1994

[87] PCT Pub. No.: WO93/20311

PCT Pub. Date: Oct. 14, 1993

[30] Foreign Application Priority Data

Apr. 3, 1992 [DE] Germany ..... 9204580 U

[51] Int. Cl.[6] ..... A47F 5/00

[52] U.S. Cl. ..... 248/354.1; 33/493

[58] Field of Search ..... 248/354.1, 354.3, 248/354.4, 354.5, 354.6; 33/493, 483, 771, 1 H, 809

[56] References Cited

U.S. PATENT DOCUMENTS

| | | | |
|---|---|---|---|
| 160,471 | 3/1875 | Robinson | 33/809 |
| 1,781,063 | 11/1930 | Jessen | 248/354.6 X |
| 2,770,886 | 11/1956 | Johnson . | |
| 3,190,008 | 6/1965 | Weiss | 33/809 X |
| 3,328,887 | 7/1967 | Wright | 33/809 X |
| 3,374,545 | 3/1968 | Monroe | 33/809 X |
| 3,492,737 | 2/1970 | Swanson | 33/809 |
| 4,180,914 | 1/1980 | Lechner | 33/809 |
| 4,249,578 | 2/1981 | Freeman | 248/354.6 X |
| 4,899,452 | 2/1990 | Schafer | 33/809 X |
| 5,038,493 | 8/1991 | Stabs | 33/809 |

FOREIGN PATENT DOCUMENTS

| | | |
|---|---|---|
| 494622 | 9/1919 | France . |

*Primary Examiner*—Korie Chan
*Attorney, Agent, or Firm*—Larson & Taylor

[57] ABSTRACT

An adjustable-height support for shuttering in the building trade, in particular a ceiling support (1), comprises an outer tube (2) in which an inner tube (3) is guided in a displaceable fashion whose position can be fixed with respect to the outer tube (2) in a changeable fashion, by way of example via pins, threaded joints or the like. A measuring scale (9) is arranged on the outer periphery (10) over at least a portion of the inner tube (3) in the longitudinal direction.

5 Claims, 3 Drawing Sheets

ADJUSTABLE-HEIGHT SUPPORT FOR SHUTTERING IN THE BUILDING TRADE

BACKGROUND OF THE INVENTION

The invention concerns an adjustable-height support for shuttering in the building trade, in particular a ceiling support, consisting of an outer tube within which an inner tube is guided in a translatable fashion and which is capable of being fixed to the outer tube in a detachable fashion with, by way of example pins, threaded joints or the like.

A ceiling support of this type is, for example, known in the art as "Peri" (trademark) ceiling support HL 500.

With adjustable-length ceiling supports of prior art, a tape measure, a graduated ruler, or a yard stick is necessary when erecting the support in order to adjust the desired length of the support. The measurement of the support length requires a certain amount of time and measurement errors cannot be completely ruled out.

It is therefore the purpose of the invention to improve an adjustable-length support of the known kind in such a fashion that it is adjustable to the desired height in a rapid and precise fashion without having additional auxiliary means necessary therefor.

SUMMARY OF THE INVENTION

The purpose is achieved in accordance with the invention in that a measurement scale is provided over at least a portion of the outer periphery of the inner pipe in the longitudinal direction.

This has the advantage that the support in accordance with the invention can be adjusted to the desired length in a simple manner without additional auxiliary means.

The measurement scale is arranged in the direction of the longitudinal axis of the inner tube over a portion of the outer periphery of the inner tube. In particular embodiments, the measurement scale extends largely over the entire length of the inner tube. The measurement scale is thereby printed, stamped, riveted or glued in a clear and distinct fashion to the outer periphery of the inner tube so that it indicates, in a non-displaceable fashion, the current overall length of the adjusted support. The measurement scale units expressed, for example, in terms of numerals or other symbols, take into consideration the thickness of possible cover plates brought onto the ends of the outer or inner pipes.

The measurement scale is rigidly attached to the outer periphery of the inner pipe or integrated into the outer periphery in such a fashion that it is flush with the outer surface of the inner tube.

In particular, permanent and scratch-resistant materials are utilized for labelling the measurement scale to withstand the rough construction environment. A particularly sturdy kind of measurement scale is achieved by stamping the necessary markings into the outer periphery of the inner tube.

In a further embodiment of the invention, the measurement scale can be configured as a tape measure in a groove on the outer periphery of the inner tube. In this configuration of the measurement scale, it is possible for the tape measure to be exchanged with other tape measures having different labelling units (metric, English, inch, Japanese, Chinese and the like).

Fluorescent materials can also be utilized for labelling the measurement scale so that the measurement scale on the supports in accordance with the invention can also be clearly discernable in dark areas or under, poor visual conditions. With this type of labelling, measurements errors are largely eliminated.

In an additional embodiment of the support in accordance with the invention a plurality of measurement scales are located along the outer periphery of the inner tube. In this fashion it is possible for the length of the current support to be immediately and uniquely recognized from different perspectives so that a support suitable for a particular job can be chosen rapidly and without error.

Should the ceiling support in accordance with the invention be galvanized or made from a aluminium and exhibit appropriate scales, then the ceiling support of this kind represents a valuable tool for construction sites which can be utilized in a rapid, simple and reliable fashion.

Should adjustable-height supports be utilized which exhibit threaded joints between the outside and the inside tubes then additional holding means such a pins are no longer necessary for adjusting the desired dimensioning.

Further advantages can be derived from the description and the accompanying drawing. The above mentioned features and those which are to be explained below can also be utilized in accordance with the invention individually or collectively in arbitrary combination. The embodiments mentioned are not to be understood as exhaustive enumeration rather have exemplary character only.

The invention is represented in the drawing and is explained more clearly in relation to the embodiments.

DESCRIPTION OF THE PREFERRED EMBODIMENT

Figure 1:
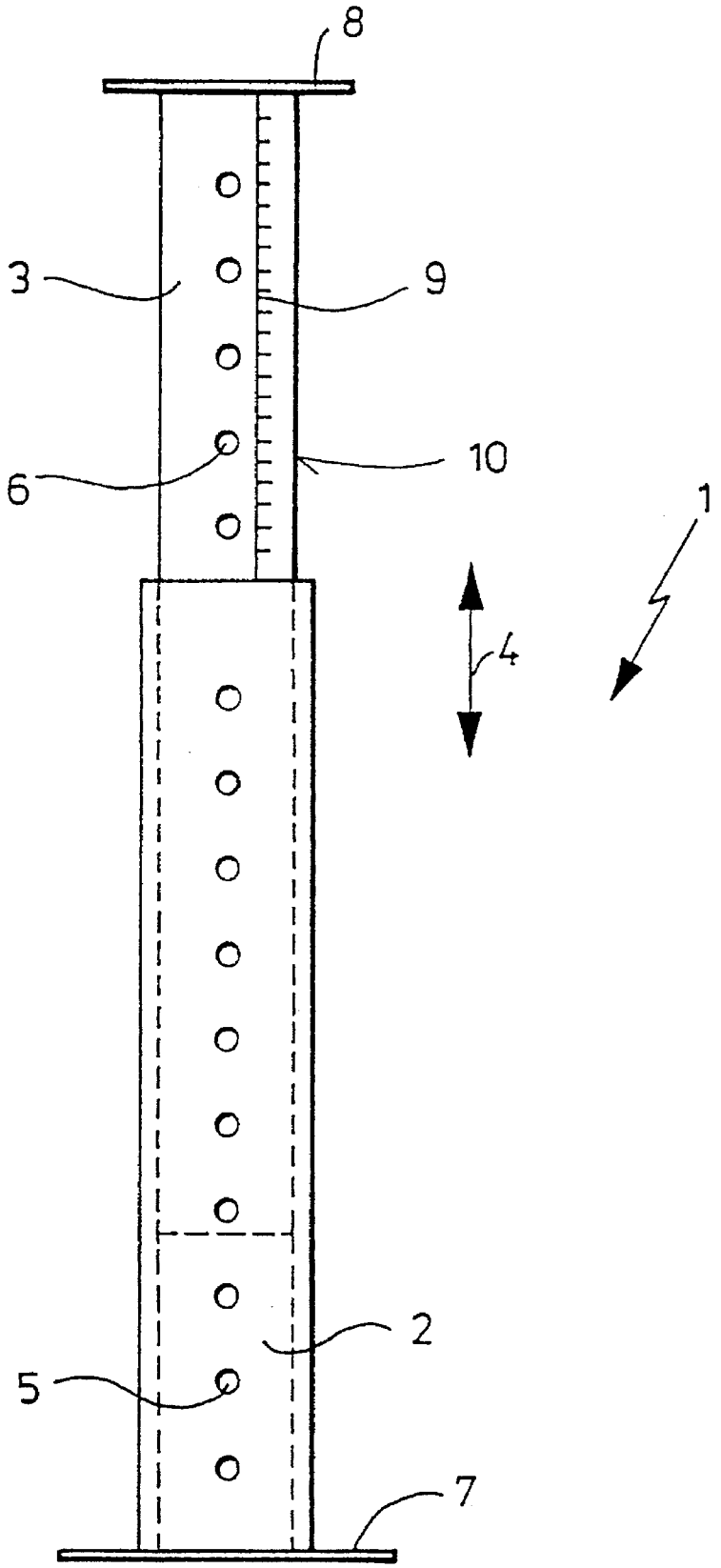
FIG. 1 shows a ceiling support in accordance with the invention with an outer and inner tube and measurement scale.

The individual figures of the drawing partially show the object in accordance with the invention in a strongly schematic fashion and are not to be taken to scale.

FIG. 1 shows a ceiling support 1 consisting of an outer tube 2 and an inner tube 3. The inner tube 3 is displaceable relative to the stationary outer tube 2 in the direction of the arrow 4. The outer tube 2 exhibits openings 5 distributed along the longitudinal direction which pass through the outer tube 2 in a fashion which is known in the art. Comparable openings 6 pass through the inner tube 3 and are aligned with the openings 5 in the outer tube 2 at certain positions. A base plate 7 is attached to the outer tube 2 by means of which the outer tube 2 is supported upon a solid foundation over the entire area. A ceiling plate 8 is securely attached to the inner tube 3 at the free end of the inner tube 3. The ceiling support 1 supports, via the ceiling plate 8, a ceiling which is to be constructed or any other kind of shuttering element being utilized for other purposes.

A measurement scale 9 is provided in the longitudinal direction of the inner tube 3 which is large and distinctly arranged on the outer periphery 10 of the inner tube 3. The measurement scale 9 can comprise arbitrary labellings such as lines, numerals or the like. When adjusting a particular support length, the inner tube 3 is appropriately pulled out from the outer tube 2 or pushed into the outer tube 2 and when the openings 5 and 6 are flush, the ceiling length can be fixed in position in a non-displaceable fashion by means of pins which are not shown in the figure. Other supports are known which, for example, have lengths which are continuously adjustable by means of threaded joints. A measurement scale 9 in accordance with the invention is also provided for in supports of this type or is provided in the form of successive embossments. The support in accordance with the invention can have inner as well as outer tubes of arbitrary cross-section. The cross-sections of the inner and outer tube must, however, be adapted to each other in such a fashion that the inner tube can be guided and longitudinally displaced within the outer tube.

Figure 2:
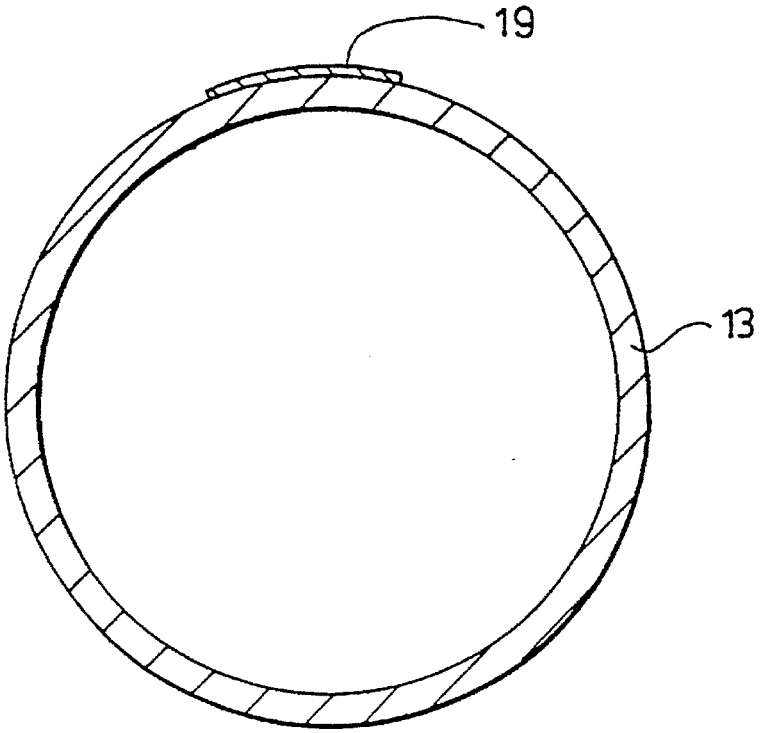
FIG. 2 shows a cross-section of a circular inner tube with a measurement scale attached to the outer periphery.

FIG. 2 shows a cross-section of an inner tube 13 which, by way of example, is round in the figure. A measurement scale 19, likewise shown in cross-section, is provided along the periphery of the inner tube 13. The measurement scale 19 is Attached to the outer periphery of the inner tube 13 in a non-displaceable fashion. The measurement scale 19 can, however, also be spray painted. Towards this end, it is obvious that substances and materials which are scratch-resistant and capable of withstanding the elements should be utilized for paints of this type.

Figure 3:
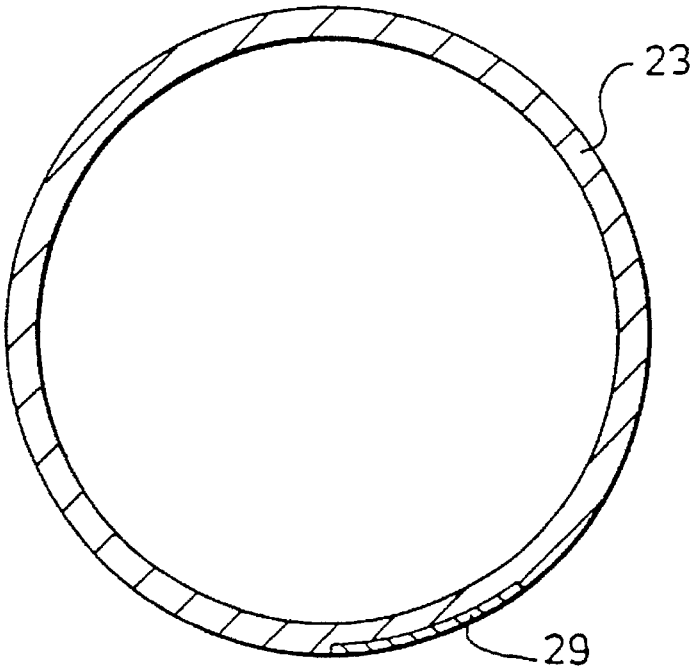
FIG. 3 shows a cross-section through an inner tube of a support in accordance with the invention with inserted measurement scale.

FIG. 3 shows a further configuration of a support inner tube 23 in accordance with the invention. The inner tube 23 exhibits a measurement scale 29 which is inserted flush with respect to the outer periphery. The measurement scale 29 can be inserted into the outer periphery of the inner tube 23 in the form of a tape or can be embossed on the surface of the inner tube 23. If this is thereby possible for the embossed positions of the measurement scale to be filled with a particularly scratch-resistant paint it is also possible for the paint to exhibit fluorescent components.

Figure 4:
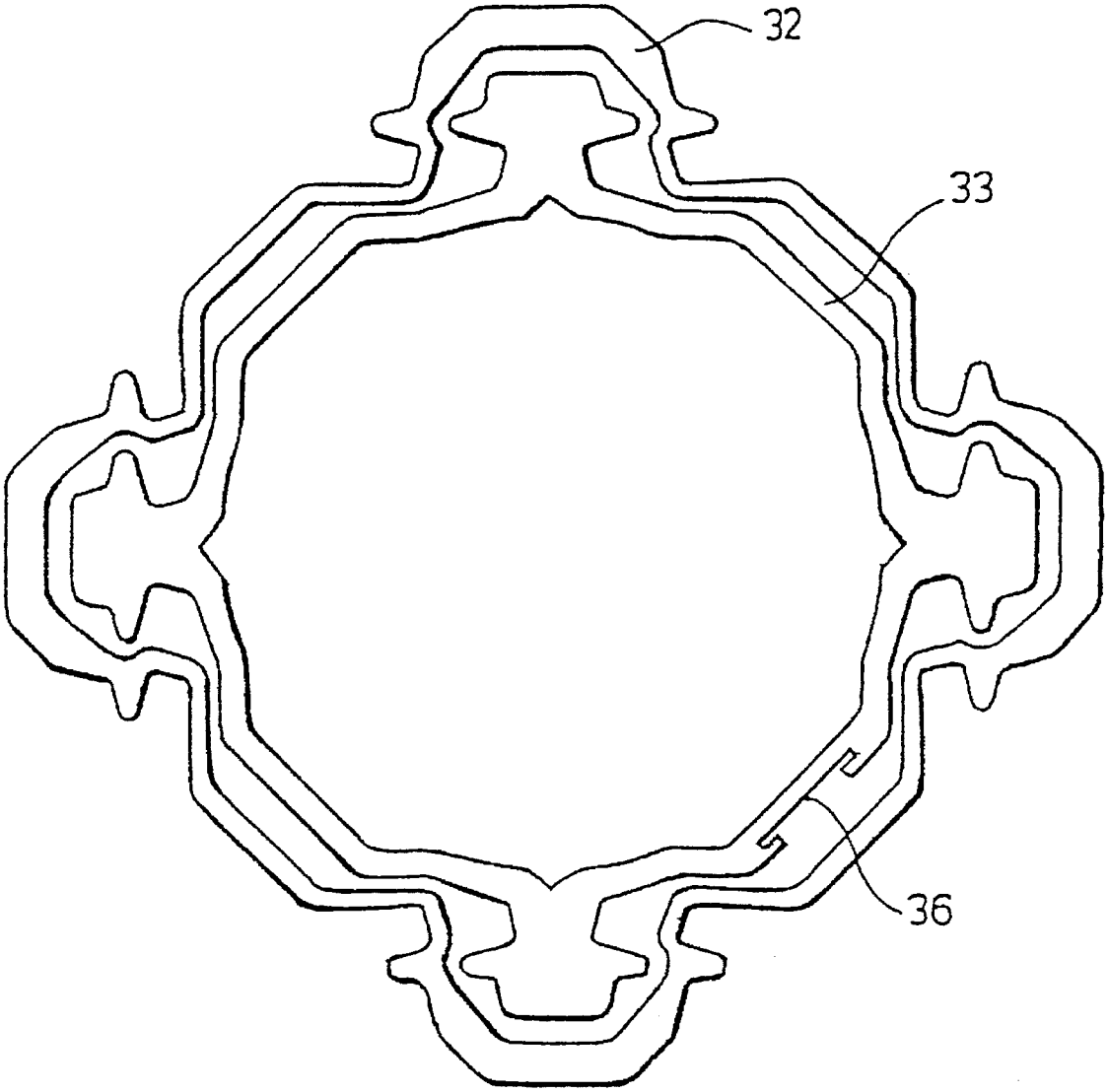
FIG. 4 shows a cross-section through a support in accordance with the invention having an outer and an inner tube which exhibits a profiled cross-section with a groove for accepting the measurement scale in the form of a tape measure.

FIG. 4 shows a cross-section of another support comprising a profiled outer tube 32 within which a correspondingly profiled inner tube 33 is guided. The length of the support is adjustable by longitudinally displacing the inner tube 33 within the outer tube 32. The inner tube 33 can be fixed in a non-displaceable fashion to the outer tube 32 by means of a threaded joint not shown in the figure. The support shown in FIG. 4 is continuously adjustable in length. The inner tube 33 exhibits a groove 36 within which a measurement scale is seated along the entire length of the inner tube 33. The measurement scale can be in the form of a tape introduced into the groove. The groove 36 is, for example, only configured on one side portion of this inner tube. The groove 36 can, however, also be additionally configured on other appropriate surfaces on the outer periphery of the inner tube 33.

As shown in FIG. 1, the division of the measurement scale 9, that is to say, the separation between the individual markings (these are lines in FIG. 1) is substantially smaller than the separation between the openings 6 in the inner tube 3 to which the measurement scale 9 is attached. In the example, the separation between two openings 6 is four times the separation between two lines of the measurement scale 9.

We claim:

1. Adjustable-height support comprising: outer and inner tubes, for supporting a vertical load; said inner tube being guided in a displaceable fashion within the outer tube, the inner tube having a longitudinal groove in an outer surface, attachment means for fixing the inner tube with respect to the outer tube; and tape measure means removably seated within the longitudinal groove to provide an exchangeable measurement scale along at least a portion of the inner tube for measuring a displacement of the inner tube relative to the outer tube.

2. The adjustable-height support of claim 1, wherein the tape measure means are seated within the longitudinal groove to facilitate exchanging of other types of tape measure means.

3. The adjustable-height support of claim 1, wherein the tape measure means is coated with weather and scratch resistant material.

4. The adjustable-height support of claim 1, wherein the tape measure means is fluorescent.

5. The adjustable-height support of claim 1, wherein the inner tube has at least one additional longitudinal groove in the outer surface and the support further comprises at least one additional tape measure means seated within the additional longitudinal groove to provide at least one additional measurement scale along at least one additional portion of the inner tube.

* * * * *